US005454245A

United States Patent [19]

Markisello

[11] Patent Number: 5,454,245

[45] Date of Patent: Oct. 3, 1995

[54] APPARATUS AND METHOD FOR REMOVING SIDE-BAR AUTOMOTIVE IGNITION LOCKS WITHOUT DAMAGE

[76] Inventor: Frank Markisello, 91-10 Liberty Ave., Ozone Park, N.Y. 11417

[21] Appl. No.: 247,577

[22] Filed: May 23, 1994

[51] Int. Cl.[6] ..... E05B 19/20

[52] U.S. Cl. ..... 70/252; 29/426.4; 29/426.5; 70/368; 70/371; 70/394; 70/465; 408/72 B; 408/115 B

[58] Field of Search ..... 70/417, 465–466, 70/394, 495, 496, 367, 368, 371, 252; 33/539, 540; 206/223; 29/426.1, 426.4, 426.5; 408/72 B, 97, 115 R, 115 B, 241 B, 202, 241 S; 7/100

[56] References Cited

U.S. PATENT DOCUMENTS

| | | | |
|---|---|---|---|
| 2,007,143 | 7/1935 | Keil | 70/367 |
| 4,586,233 | 5/1986 | Markisello | 29/426.5 X |
| 4,682,398 | 7/1987 | Markisello | 29/426.4 |
| 4,865,493 | 9/1989 | Miller | 70/465 X |
| 5,325,691 | 7/1994 | Embry | 70/394 |
| 5,402,661 | 4/1995 | Markisello | 70/394 |

*Primary Examiner*—Lloyd A. Gall
*Attorney, Agent, or Firm*—Nathaniel Altman

[57] ABSTRACT

Apparatus and method for removing side-bar automotive ignition locks without damage, a tool kit being provided containing a drill guide block, an adjustably molted drill bit, a side-bar pressure tool for insertion into the access opening created by the drill bit, and a wafer pressure tool for insertion into the keyway of the ignition lock to urge the lock wafer elements into alignment at the same time the side-bar pressure is being applied, causing retraction of the side-bar and consequent opening of the lock to permit its removal. Plugs are provided to reseal the drilled access opening.

10 Claims, 2 Drawing Sheets

10
12
14
16
18
20
22
24
26
28
30
32
34
36
38
40
42
44
46
48
50
52
54
56
60
62
64
66
68
70
72
74
76
78
80
82
84

APPARATUS AND METHOD FOR REMOVING SIDE-BAR AUTOMOTIVE IGNITION LOCKS WITHOUT DAMAGE

FIELD OF THE INVENTION

This invention relates to automotive ignition locks; more specifically, it is concerned with side-bar ignition locks and their removal when locked and without a key for the purpose of making a substitute key.

BACKGROUND OF THE INVENTION

Side-bar lock cylinders have come into wide use in automotive ignition locks. Until now, no product or method has emerged in the prior art successfully to opens, these locks for removal from their mountings for key replacement without destructive damage to either the lock cylinder or the entire lock assembly, rendering them unreusable and requiring their replacement.

The present novel invention has been conceived and developed to solve this problem, and its principal object is to provide to the locksmith inexpensive apparatus for the purpose and easy undamaged ignition lock removal. A more specific object of this invention is to provide as apparatus an economical kit of tools capable of carrying out the invention's method which applies pressure on the ignition lock cylinder's side-bar while urging the lock cylinder's wafers into alignment so that the side-bar latch is retracted, allowing the lock to be opened and removed. A still further object of the invention is to provide a set of tools as apparatus which are inexpensive to manufacture, simple to use, and capable of saving ignition locks for reuse rather than destroying them.

SUMMARY OF THE INVENTION

The side-bar on the cylinder of an ignition lock normally prevents the lock cylinder from turning in rots housing to the "on" position without a key; the insertion of the key into the ignition keyway causes the side-bar to retract, thus permitting the lock cylinder to to be rotated; with the lock in the "on" position, an outer latch on the lock housing can be retracted to allow easy removal of the lock assembly for conventional key-making.

The apparatus of this invention, and the method of using it, comprise a drill guide block having at least one locating projection to be inserted in the lock's keyway, the guide block being dimensioned to fit snugly between the wings of the ignition cylinder wing-nut cap and having a small-bore guide hole precisely positioned therethrough; a drill bit mounted adjustably on an arbor, the shoulder of which acts as a stop to limit the depth of penetration of the drill bit into the ignition lock when drilling a small access opening into the ignition lock so that lock damage is avoided. The access opening thus created is so located that a side-bar pressure tool from the kit inserted therein closely overlies the lock cylinder's side-bar; turning the handle of the side-bar pressure tool applies inward pressure against the side-bar. While this pressure is being applied, a wafer pressure tool from the kit is inserted into the cylinder keyway and moved in a reciprocating motion inwardly and outwardly to align the ignition lock wafers, causing them to assume the position they reach when a key is inserted. When this is achieved, the side-bar, under the pressure the side-bar tool is exerting, is retracted into the cylinder and the lock is in unlocked condition; on removal of the pressure tools, the cylinder can be rotated by its wing-nut cap to the "on" position for easy removal of the ignition lock assembly. Thereafter, a key may be fitted to the lock, a plug from the kit inserted into the access opening in the face of the cylinder wing-nut cap, and the ignition lock assembly repositioned in its automotive mounting for continued use.

The above-outlined apparatus and method will be described in full detail in connection with the accompanying drawings which are illustrative of, but not limiting, the concepts of this invention and wherein:

SHORT FIGURE DESCRIPTION OF THE DRAWINGS

DESCRIPTION OF THE PREFERRED EMBODIMENTS

Figures 1, 2, 3, 4:
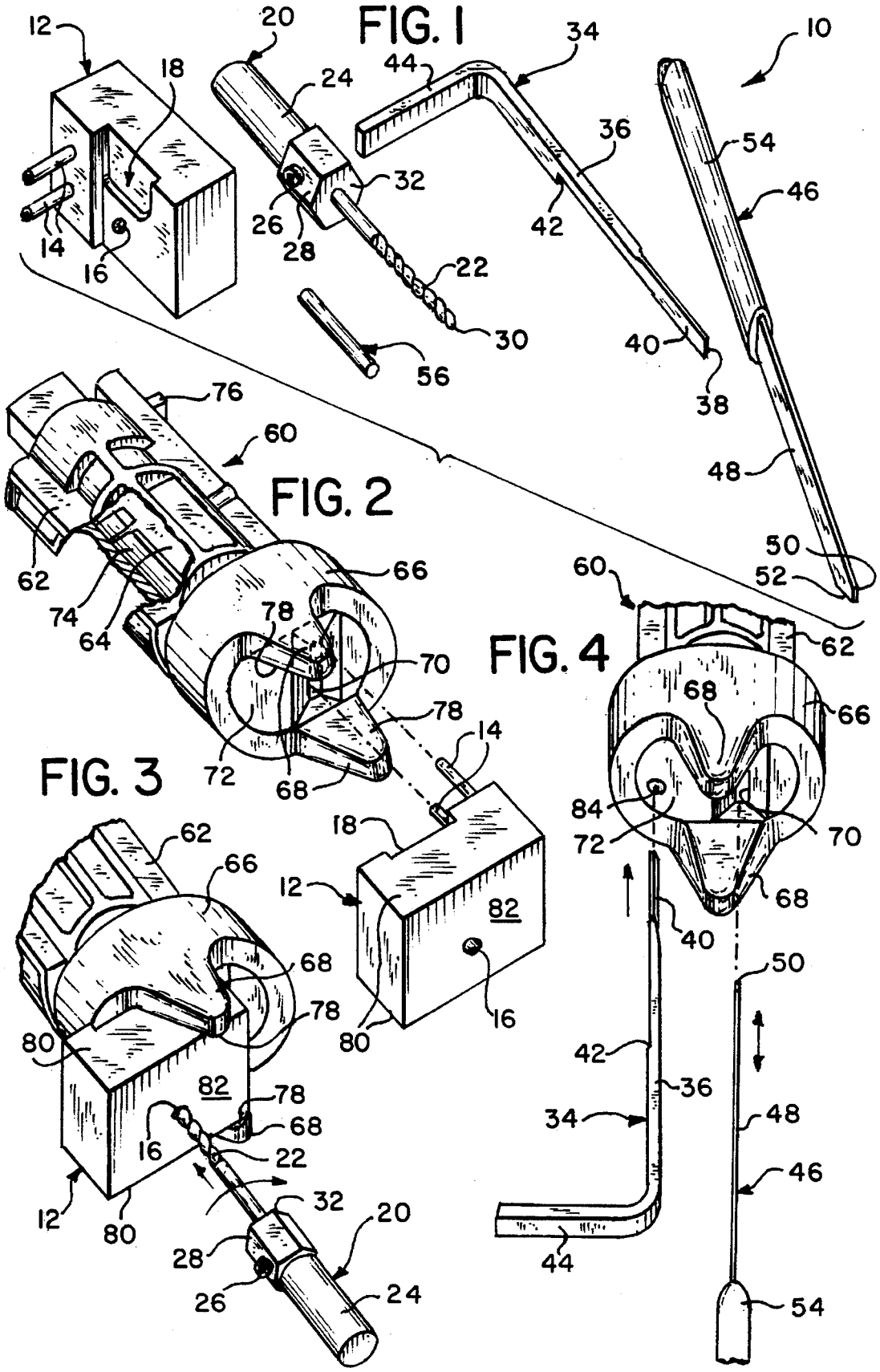
FIG. 1 illustrates the elements of the apparatus included as a kit for use in the practice of this invention, all the elements being shown in perspective.
FIG. 2 is a perspective view of a typical side-bar lock assembly, partially broken away, with the drill guide block of the apparatus in position to be mounted thereon.
FIG. 3 is a partial perspective view of the lock assembly of FIG. 2 with the drill guide block in place and the drill bit of the apparatus boring an access opening in the lock.
FIG. 4 is a partial perspective view of the lock assembly of FIG. 2 with the side-bar pressure tool and the wafer pressure tool of the kit poised for insertion respectively into the access opening previously drilled and the keyway of the lock assembly.

Apparatus kit 10 of FIG. 1 includes metal drill guide block 12, which has pins 14 projecting at a right angle therefrom and drill guide hole 16 extending therethrough. A cutout portion 18 of block 12 is provided to accommodate and fit over some ignition lock assemblies now in use which have projecting screwheads or the like on their faces.

Drill bit assembly 20 comprises drill bit 22, matching in size drill guide hole 16 in block 12 and adjustably mounted on arbor 24. A set screw 26 in hexagonal portion 28 of arbor 24 permits adjustment of the effective length of drill bit 22, measured by the distance between the free pointed end 30 of bit 22 and face 32 of arbor 24, face or shoulder 32 acting as a stop to prevent drilling the ignition lock beyond a safe limit, thus avoiding lock damage.

Kit 10 also includes side-bar pressure tool 34 comprising elongated portion 36 terminating at its free end 38 in a slightly twisted blade end 40 for contacting and putting pressure against the ignition lock side-bar, when in use. Portion 36 has a step 42 for limiting the depth of the insertion thereof into the lock to align blade end 40 with the lock side-bar. Handle 44 of tool 34 extends substantially at a right angle to portion 36 from its end opposite blade end 40.

Wafer pressure tool 46 in kit 10 comprises flat metal blade 48 with one corner of its free end 50 angularly cut off at 52. At its opposite end, blade 48 is provided with plastic handle 54. Tool 46 is to be inserted into the ignition lock keyway with an in-and out movement to urge the lock's wafers into alignment while tool 34 is exerting pressure against the lock side-bar.

Kit 10 may also include plastic plugs 56 (one shown), each for insertion into an access opening created by drill bit assembly 20, after the ignition lock has been removed successfully from an automotive mounting and before replacing it therein.

In FIG. 2, typical ignition lock assembly 60 comprises lock housing 62 enclosing lock cylinder 64 therein. Plastic ignition lock cylinder cap 66, mounted on and rotating with cylinder 64, has opposing wings 68 projecting forwardly therefrom, with keyway 70 extending inwardly from face 72 of cylinder cap 66. Lock housing 62 is broken away in this view to show side-bar 74 which, when lock assembly 60 is in the locked "off" position as shown here, projects outwardly from cylinder 64 and prevents it from rotating within housing 62. Near the inner end of lock assembly 60, latching element 76 projects outwardly from lock housing 62 into the automotive mounting (not shown) from which lock assembly 60 in its "off" position cannot be removed.

The inventive process and method for opening lock 60 without a key begins by installing drill guide block 12 onto lock face 72, as best seen in FIGS. 2 and 3. Pins 14 projecting from block 12 are sized and spaced to engage the walls of keyway 70 and hold block 12 firmly in place against lock face 72. Further support for Block 12 is provided by the inner flat surfaces 78 of cylinder cap wings 68. Surfaces 78 are in contact with the corresponding surfaces 80 of block 12, which is thereby held precisely in position for the drilling operation through its guide hole 16 as shown in FIG. 3. Here, drill bit 22 of assembly 20 has been introduced into guide hole 16 and drilling may proceed by means of a conventional drill (not shown) mounted on arbor 24, until shoulder 32 of arbor 24 reaches facing surface 82 of drill guide block 12, which limits drilled access opening 84 (FIG. 4) to a predetermined safe depth.

With drill guide block 12 and drill bit assembly 20 now removed, FIG. 4 shows lock assembly 60 prepared for the insertion of blade end 40 of side-bar pressure tool 34 into access opening 84 to the depth allowed by tool 34's step 42, which serves as a stop when it contacts surface 72 of cylinder cap 66. Blade 48 of wafer pressure tool 46 is now to be inserted in keyway 70.

Figure 5:
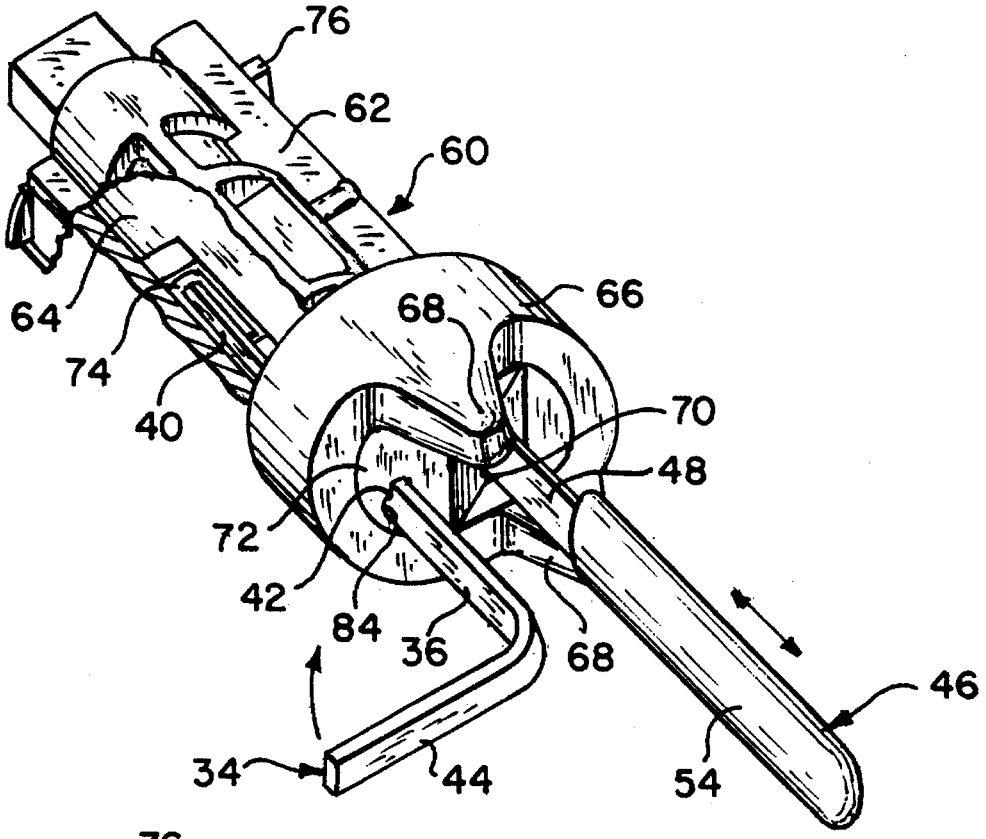
FIG. 5 is a perspective view, partially broken away, of the lock assembly with beth pressure tools inserted and operating therein.
Figure 6:
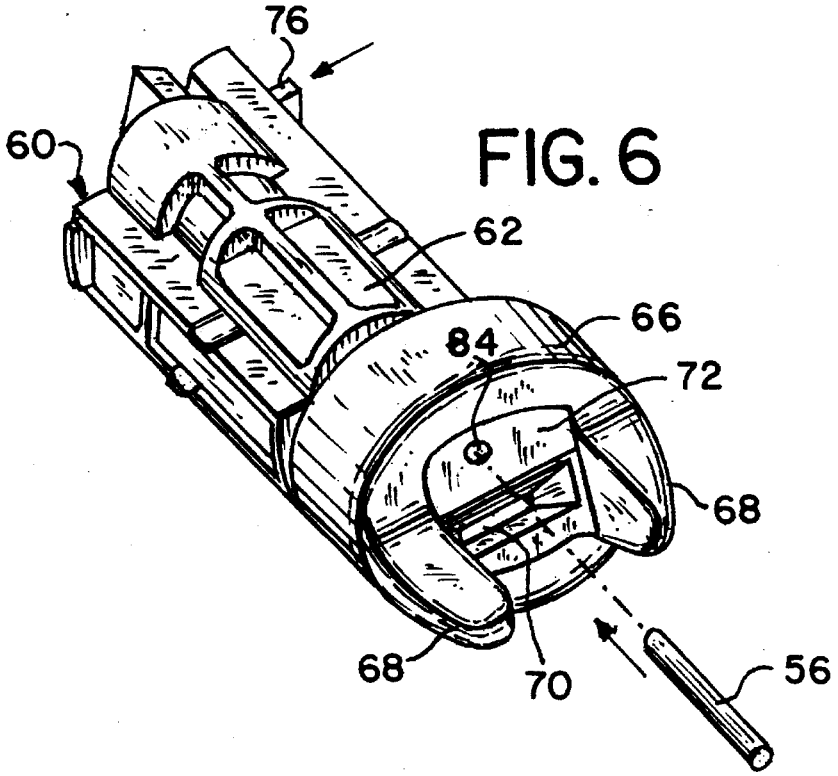
FIG. 6 is a perspective view of the lock assembly of FIG. 2, with the lock cylinder now rotated to the open or "on" position, and with the access opening plug poised to be inserted into the opening.

As shown in FIG. 5, slightly twisted blade end 40 is now aligned with cylinder side-bar 74 and, by rotating handle 44 of tool 34 in a clockwise direction, blade end 40 is brought into contact with, and exerts inward pressure against, side-bar 74. While maintaining this pressure through tool 34, wafer pressure tool 46 is moved in a reciprocating manner inwardly and outwardly in keyway 70 to urge lock cylinder 64's wafers into the alignment they assume when a key is introduced; when this alignment occurs, the retraction of side-bar 74 can be felt, and lock cylinder 64 is freed, to be turned to the "on" position of FIG. 6 after removal of tools 34 and 46. In this open position, projecting latch 76 is retractable into housing 62 and lock assembly 60 can therefore be removed readily from its automotive mounting for conventional keymaking. Before returning ignition lock assembly 60 to its mounting for resumed use, a plastic plug 56 may be inserted into access opening 84; now ignition lock assembly 60 is fully restored.

The best apparatus and method for practicing the concepts of this invention as now contemplated have been described as an illustrative embodiment. Various substitutions, modifications and alternative embodiments are envisioned and will be apparent to those skilled in the art, all falling within the boundaries of these concepts, which are limited only by the scope of the ensuing claims.

What is claimed is:

1. Method of removing a side-bar automotive ignition lock without damage, which comprises the steps of:

mounting a drill guide block on a face of a wing-nut cylinder cap of the ignition lock by inserting at least one element projecting from the guide block into the lock's keyway, the guide block having a drill guide hole therein and being held firmly between wings of the lock cylinder cap;

inserting a drill bit, held adjustably in an arbor, into the guide hole of the guide block, and drilling an access opening into the ignition lock to a depth limited by the contact between a shoulder of the arbor and the face of the ignition lock cylinder cap;

removing both drill bit and drill guide block:

inserting a side-bar pressure tool into the drilled access opening and rotating its handle clockwise to bring a blade end of the side-bar tool into contact with, and exerting inward pressure on, a side-bar of the ignition lock;

while maintaining the pressure on the lock's side-bar, inserting a wafer pressure tool into the keyway of the ignition lock and moving the wafer pressure tool therein in a reciprocating in-and-out motion to urge wafer lock elements into alignment, thereby causing the side-bar of the lock to be retracted;

removing both side-bar and wafer pressure tools; and turning the lock cylinder cap to an "on" position and removing the lock from its mounting in a conventional manner.

2. The method of claim 1, comprising the further steps of:

inserting a cylindrical plug into the drilled access opening to reseal the ignition lock's cylinder cap;

making a key for the ignition lock by conventional methods; and returning the ignition lock into its automotive mounting for continued use thereof.

3. In combination with an automotive ignition lock having wafer elements and a side a set of tools for removing said ignition lock comprising:

a drill guide block for mounting on a face of said ignition lock having a locating guide hole therein;

a drill bit fitting said side hole for drilling an access opening into said ignition lock;

a side-bar pressure tool for inserting into said access opening to apply inward pressure against the side-bar of said lock; and a wafer pressure tool for insertion into the keyway of said lock to urge the alignment of the wafer elements of said lock while said side-bar is being pressured, whereby said side-bar is retracted, and said ignition lock may be opened and removed from its molting.

4. Apparatus for removing side-bar automotive ignition locks having projecting wings without damage, comprising a lock removal tool kit which comprises..

drill guide means for mounting on a face of a side-bar ignition lock, said drill guide means having at least one element projecting at a right angle therefrom to be inserted fittingly into said lock's keyway for positioning and stabilizing said drill guide means so that a drill guide hole therein is accurately located, said drill guide means being dimensioned to fit securely between the projecting wings of said ignition lock's wing-nut cylinder cap;

drill bit means for drilling an access opening to a preselected depth in said side-bar ignition lock through said drill guide hole in said drill guide means;

side-bar pressure tool means for insertion into said access opening in said ignition lock for contacting and applying inward pressure to a side-bar of said ignition lock; and wafer pressure tool means for insertion into said keyway of said ignition lock to exert pressure on and urge wafer elements of said lock into alignment, so that said lock side-bar is retracted into said lock under said inwardly applied pressure and said ignition lock may be turned to an "on" position and removed from its automotive mounting.

5. Apparatus as defined in claim 4, wherein said drill guide means is substantially a right-angled six-sided metal block with at least one area cut from a surface thereof to allow for irregularities on the face of any said side-bar ignition lock cylinder cap, thus assuring a firm level seating of said drill guide block on said ignition lock face.

6. Apparatus as defined in claim 5 wherein said at least one projecting element of said drill guide means is a pair of pins extending from the surface of said drill guide means which seats on said ignition lock cylinder cap face, said pins being aligned, dimensioned and spaced so as to fit firmly against the inner walls of said keyway of said ignition lock.

7. Apparatus as defined in claim 4, wherein said drill bit means comprises:

a drill bit dimensioned to fit through said drill guide hole in said drill guide means;

an arbor for adjustably mounting said drill bit therein, said arbor having a solid rounded end to be gripped and driven by a conventional drill, the opposite end of said arbor being hexagonal in cross-section and having a bore centrally disposed to receive said drill bit adjustably therein; and a set screw threaded into said hexagonal end of said arbor adjustably, so that the distance between a pointed end of said drill bit and a flat shoulder of said hexagonal end of said arbor can be selected to match the required depth of said access opening in said ignition lock for reaching said lock's side-bar with said side-bar pressure tool means.

8. Apparatus as defined in claim 4, wherein said side-bar pressure tool means comprises an L-shaped member of rectangular cross-section with a handle thereof being a short side of the L substantially at a right angle to a longer side of said tool means, said longer side extending unchanged in dimensions for approximately one-third of its length from said handle, then being reduced in height for a middle third of its length, thus forming a step therebetween, said step serving as a stop against the face of said ignition lock when said tool means is inserted into said access opening, a final third of said longer side being reduced in thickness to a blade slightly twisted out of the plane of the rest of said longer side, said final third blade section being adapted to contact and apply inward pressure against said side-bar of said lock when said tool means is in operative position in said access opening of said lock and said handle of said side-bar tool means is turned clockwise.

9. Apparatus as defined in claim 4, wherein said wafer pressure tool means comprises a thin flat blade with one corner of its free operative end cut off at an angle, the opposite end of said blade being covered by a protective handle, said blade being of sufficient length to reach and apply pressure to urge all said wafer elements of said ignition lock into aligned open-lock position.

10. Apparatus as defined in claim 4, wherein said lock removal tool kit further comprises at least one cylindrical plug dimensioned to fit into and fill said access opening in said side-bar ignition lock, said plug to be inserted in said opening after the removal of said lock from its automotive mounting for keymaking and before its reinstallation therein.

* * * * *